US005355919A

United States Patent [19]

Knox

[11] Patent Number: 5,355,919

[45] Date of Patent: Oct. 18, 1994

[54] WOOD SPLITTING DEVICE

[76] Inventor: Paul V. Knox, 15320 Fulton Ave., No. 144, Sacramento, Calif. 95825

[21] Appl. No.: 155,588

[22] Filed: Nov. 18, 1993

[51] Int. Cl.[5] ..... B27L 7/00

[52] U.S. Cl. ..... 144/193 R; 144/184; 144/366

[58] Field of Search ..... 144/162 R, 182, 184, 144/185, 190, 193 R, 193 A, 193 C, 193 E, 194, 366

[56] References Cited

U.S. PATENT DOCUMENTS

| | | | |
|---|---|---|---|
| 168,649 | 10/1875 | Latus . | |
| 881,538 | 3/1908 | Bienk . | |
| 2,201,815 | 5/1940 | Hendricks et al. | 144/184 |
| 2,526,362 | 10/1950 | Johnston . | |
| 3,356,115 | 12/1967 | Cole | 144/193 R |
| 3,995,672 | 12/1976 | Binninger | 144/193 A |
| 4,019,548 | 4/1977 | Lenderink et al. | 144/184 |
| 4,061,168 | 12/1977 | Fariss, Jr. . | |
| 4,078,591 | 3/1978 | Syrjala et al. | 144/193 A |
| 4,275,778 | 6/1981 | Kotas . | |
| 4,478,263 | 10/1984 | Johnston | 144/193 A |
| 5,086,820 | 2/1992 | Gelder | 144/193 A |

FOREIGN PATENT DOCUMENTS

| | | |
|---|---|---|
| 33360 | of 1885 | Fed. Rep. of Germany . |
| 383707 | 10/1923 | Fed. Rep. of Germany . |
| 193574 | 10/1937 | Switzerland . |

*Primary Examiner*—W. Donald Bray
*Attorney, Agent, or Firm*—James M. Ritchey

[57] ABSTRACT

A wood splitting device comprising a body element, a splitting blade or wedge horizontally mounted in the body element, a mechanism for holding and guiding a piece of wood that is slidably mounted to the body element, a system for reciprocating the slidably mounted wood guiding mechanism, and a mechanism associated with the body element for adjusting the thickness of the split portions of the wood.

8 Claims, 4 Drawing Sheets

WOOD SPLITTING DEVICE

BACKGROUND OF THE INVENTION

1. Field of the Invention

The invention related herein is a wood splitting device. Specifically, a wood splitting device for facile preparation of varying thickness of kindling wood is disclosed. The subject apparatus comprises a body element, a splitting blade or wedge (wood splitting means) horizontally mounted in the body element, means for holding and guiding a piece of wood that is slidably mounted to the body element, means for reciprocating the slidably mounted wood guiding means, and means associated with the body element for adjusting the thickness of the split portions of the wood.

2. Description of the Related Art

Various devices for wood splitting have been disclosed in the past, involving a variety of approaches to splitting logs and wood pieces. However, the related art has not addressed the need for a wood splitting device that can split kindling wood into pieces of desired thickness by incremental adjustment. The disclosed related art has been directed generally towards the splitting of whole logs, with little control over the thickness of the resulting portions of wood.

U.S. Pat. No. 4,275,778 discloses a log splitter having a horizontal beam, a hydraulic ram mounted at one end of the beam, and a wedge mounted on the other end of the beam. Logs are split by compressing the logs against the wedge portion with the ram portion.

Described in U.S. Pat. No. 4,061,168 is a log splitting device having a jack means with a platform block mounted on the jacking mechanism, and a wedge block mounted on the jack post. A log is placed between the wedge block and the platform block and the jack is actuated to split the log.

U.S. Pat. No. 2,526,362 presents a pressed log cutter having a pair of parallel plates spaced apart, and apertures in the parallel plates into which a log can be inserted. A pivotally mounted cutter attached to a lever is mounted between the parallel plates so that when pressure is applied to the lever, the cutter is brought down against the log.

Related in U.S. Pat. No. 881,538 is a wood cleaver having a vertically mounted punch driven by rod mounted to a crankshaft. The crankshaft is driven by a lever. A log is placed in the base of a block frame, and the lever depressed to turn the crankshaft, driving the connected rod and punch into the log.

A wood splitter is disclosed in U.S. Pat. No. 168,649 having a bed member, a movable blade, and a hand lever with a toothed arc at one end that drives the movable blade along the bed and into a log.

German Patent No. 383,707 presents a wood splitter having a flat base element with a hollow cylinder vertically mounted on top of the flat base. Radially spaced screw clamps in the hollow cylinder hold the log portion to be split. A pivotally mounted lever with a blade positioned above the hollow cylinder is operated to bring the blade down against the log.

Disclosed in German Patent No. 33,360 is a wood splitting device having a base member with a block to rest logs against. A horizontally mounted rod with a wedge at one end is guided through two apertures in the base member towards the block. A vertical lever is pivotally attached to the horizontally mounted rod so that moving the lever reciprocates the cylinder, driving the wedge end of the cylinder into a the log against the block.

Swiss Patent No. 193,574 relates an apparatus for splitting wood having a pivotally mounted handle attached to a vertical base member. Near the pivoting end of the handle is a wedge mounted near the pivot point so that the wedge travels in an arc as the handle is moved. A wood supporting block extends out from the base member at an acute angle, so that by moving the handle, the wedge travels in an arc into the piece of wood supported by the block.

SUMMARY OF THE INVENTION

An object of the present invention is to provide a wood splitting device for facile splitting of wood into smaller pieces.

More specifically, it is an object of the present invention is to provide a wood splitting device useful for preparation of kindling wood.

Yet another object of the present invention is to provide a wood splitting device that allows for splitting of wood into incrementally adjustable thickness.

Disclosed is a wood splitting device comprising a body element, a splitting blade or wedge horizontally mounted in the body element, means for holding and guiding a piece of wood that is slidably mounted to the body element, means for reciprocating the slidably mounted wood guiding means, and means associated with the body element for adjusting the thickness of the split portions of the wood. A block of wood is inserted into the wood guiding means and is moved across the horizontally mounted blade, splitting off a portion of the wood. The thickness of the portion of wood to be split off of the block controlled by the adjustment means. After a portion of wood is split off the original block, the wood guiding means is draw back to its original position, and then moved across the blade again, splitting off another portion of wood of the same thickness. This process is repeated, until the wood block is completely converted into split portions.

Other objects, advantages, and novel features of the present invention will become apparent from the detailed description that follows, when considered in conjunction with the associated drawings.

DESCRIPTION OF THE PREFERRED EMBODIMENT

Figure 1:
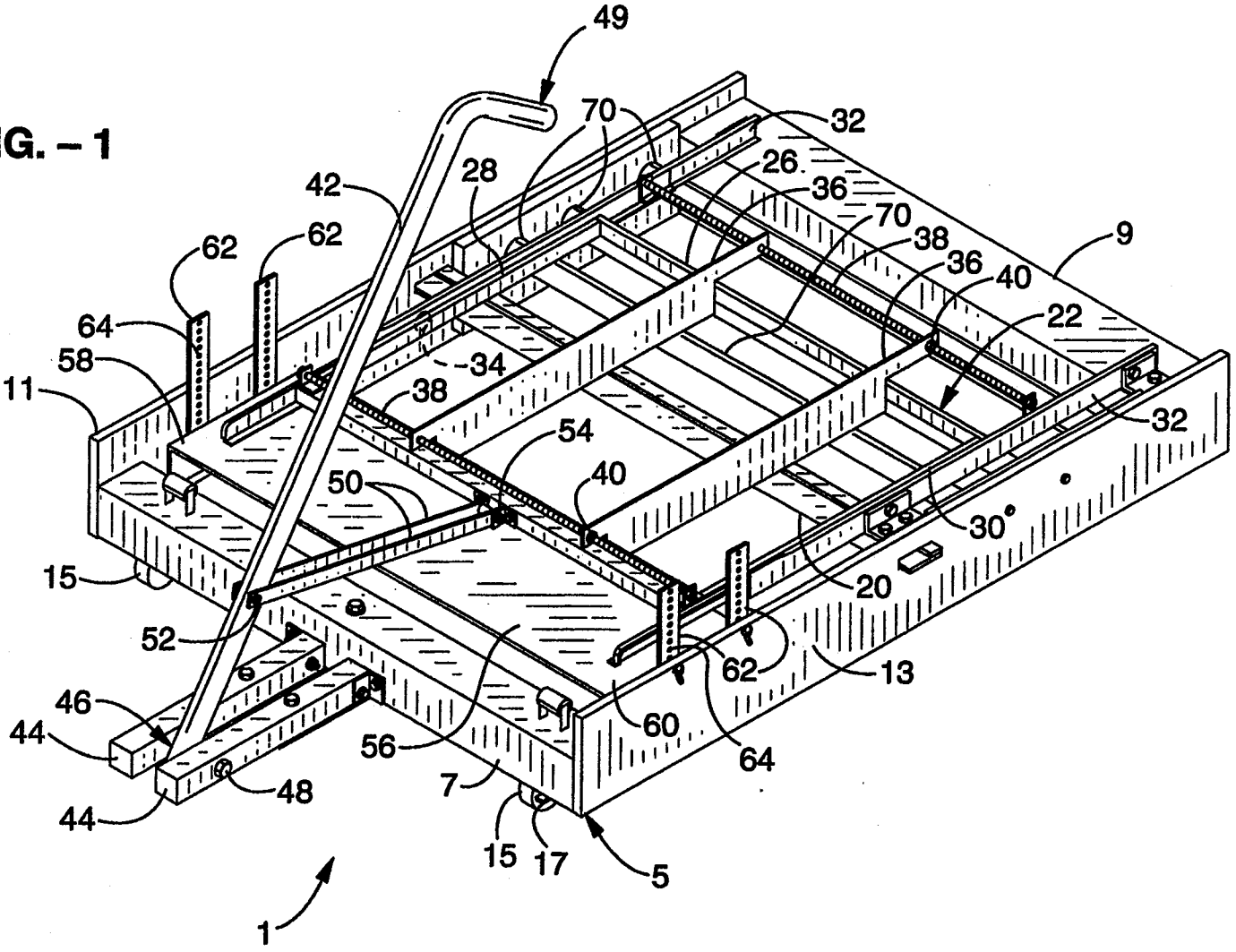
FIG. 1 is a perspective view of the wood splitting apparatus.
Figure 2:
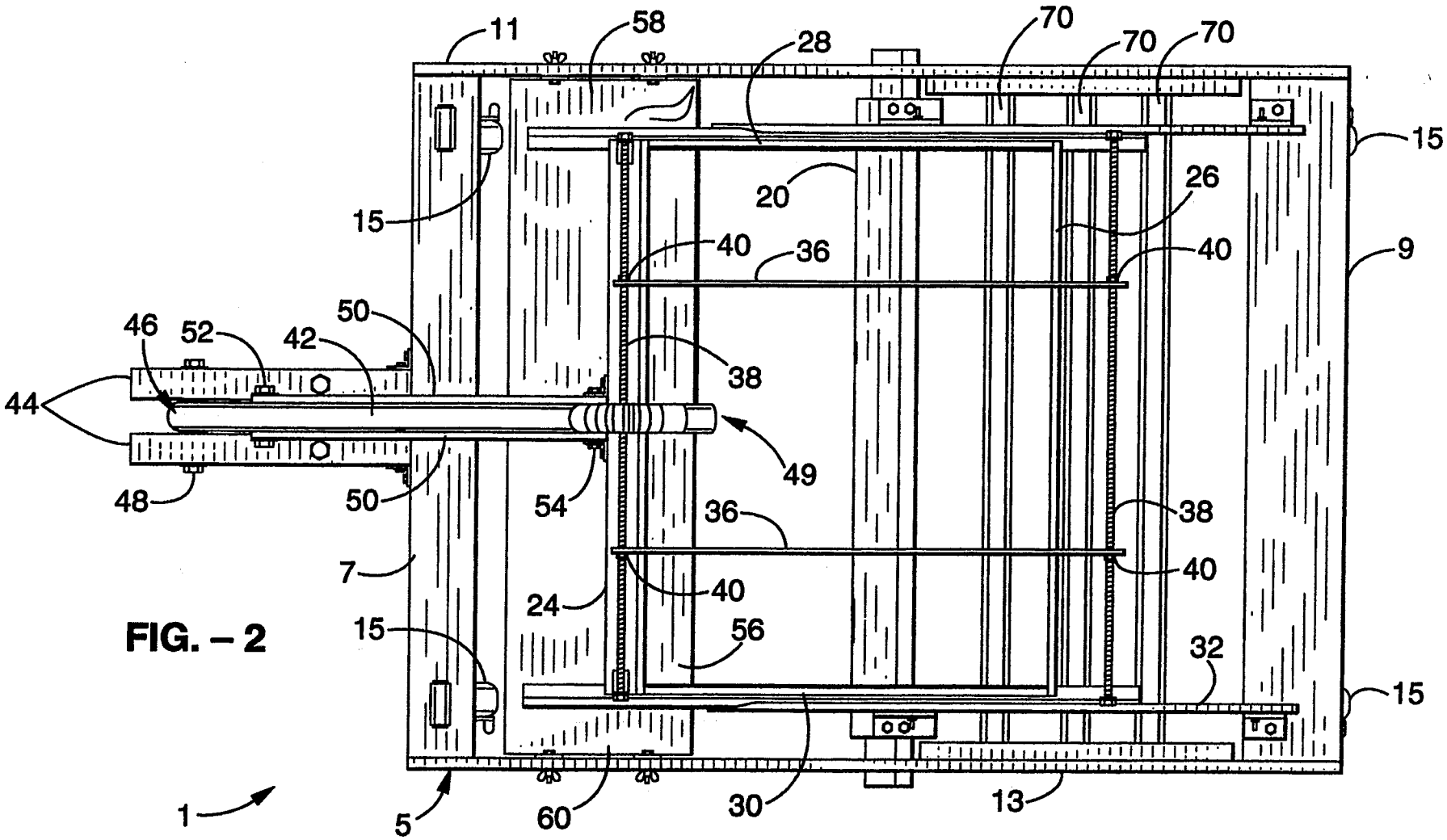
FIG. 2 is a top view of the wood splitting apparatus.
Figure 3:
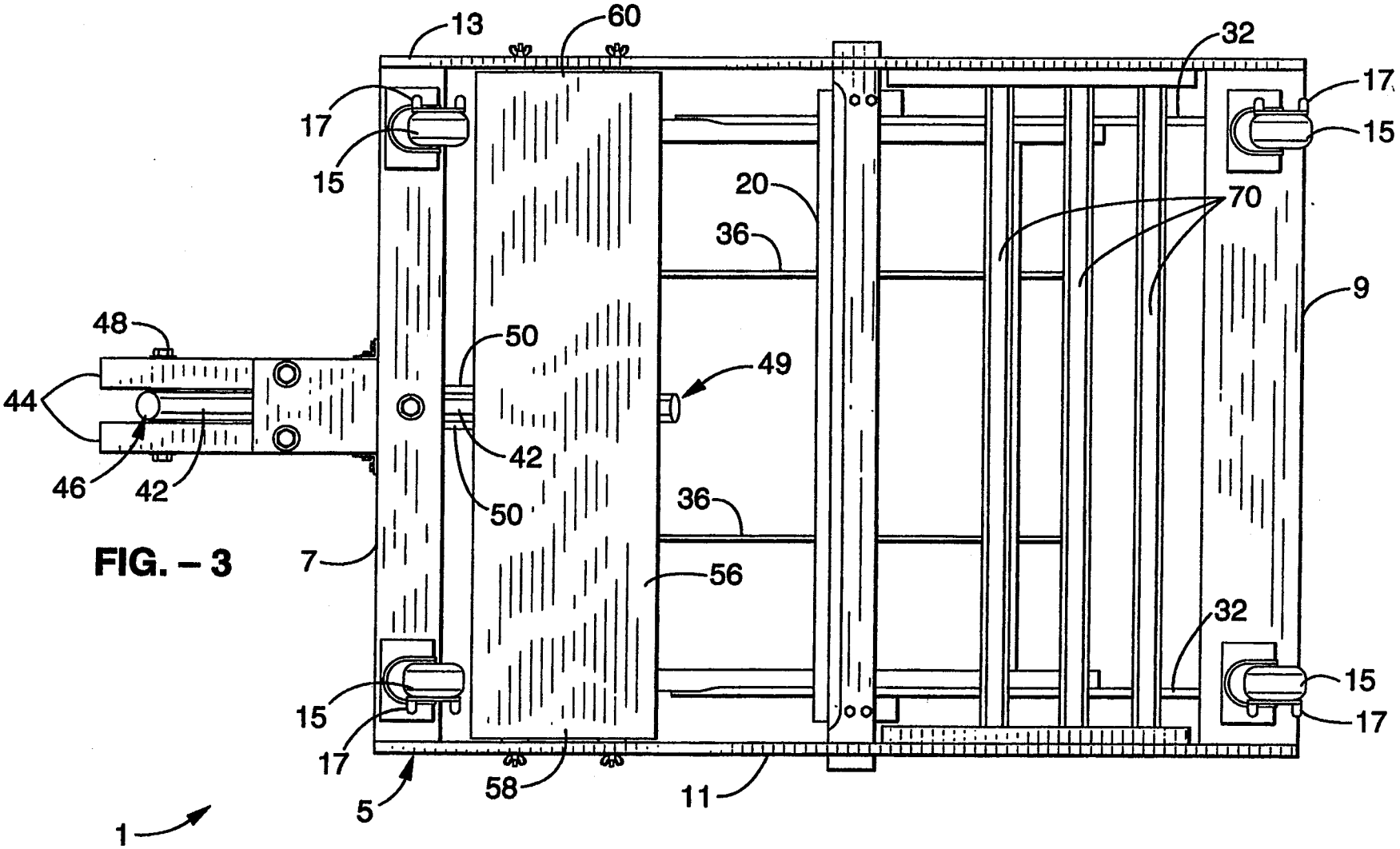
FIG. 3 is a bottom view of the wood splitting apparatus.
Figure 4A:
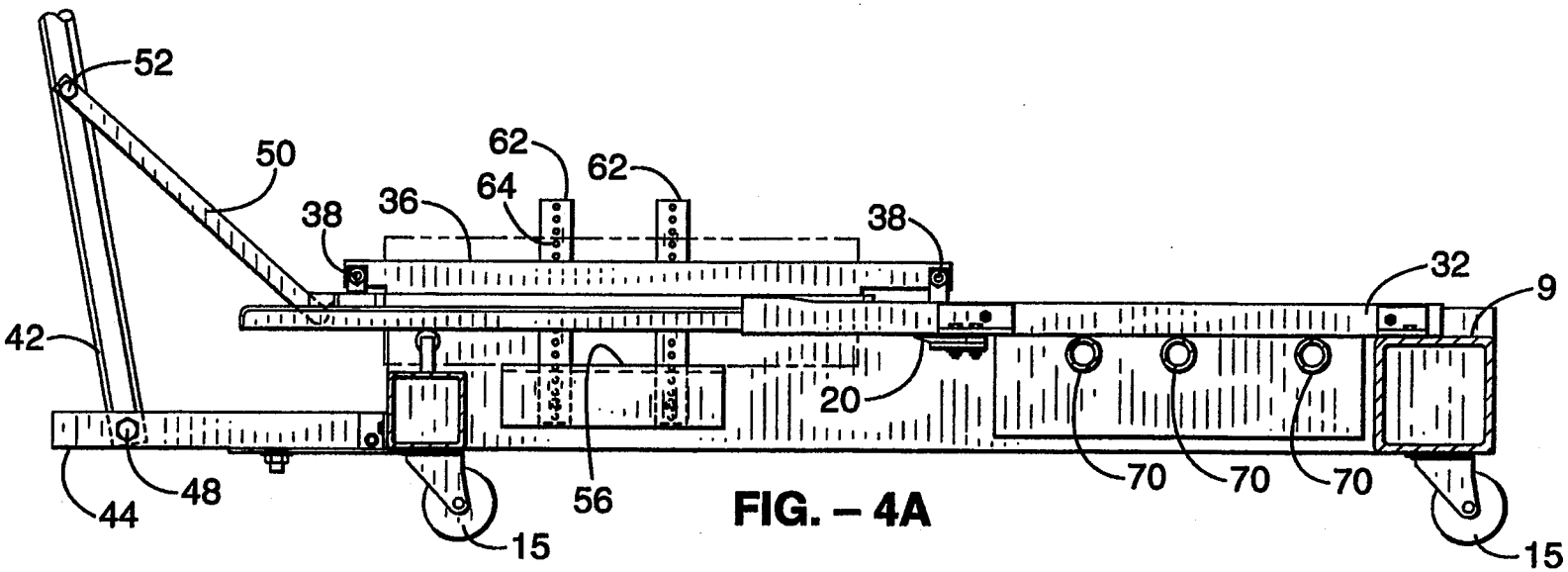
FIG. 4A is a side view of the wood splitting apparatus with the slidably mounted wood guide in a back position.
Figure 4B:
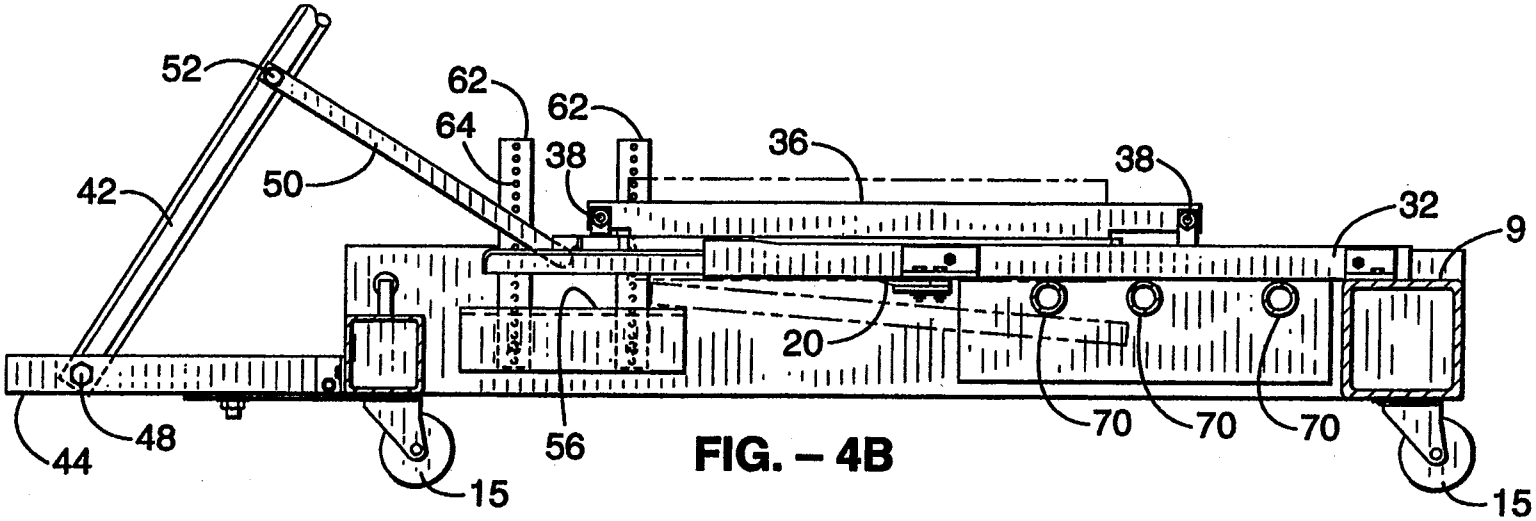
FIG. 4B is a side view of the wood splitting apparatus with the slidably mounted wood guide in a forward position.

Referring now to FIGS. 1–4 there is shown a preferred embodiment of a wood splitting device. A body element, shown here as a generally rectangular base frame 5, comprising a front support member 7, a rear support member 9, a first side 11, and a second side 13. Preferably, the base frame is supported by wheels or casters 15, the wheels or casters having braking means 17 to lock them in position. Other means for facilitating movement of the base frame over the ground, such as skids, runners, and rollers, are also contemplated. It should be readily understood that a number of other body element configurations, including substantially circular, oval, and multi-sided configurations, are considered to be within the scope of this disclosure.

Mounted into the body element is a blade or wedge 20, preferably horizontally mounted between the first 11 and second 13 sides of the base frame 5. A vertically mounted blade, or a plurality of vertically or horizontally mounted splitting blades or wedges, may also be employed in the wood splitting device.

Means for guiding wood pieces into the blade 20 are shown in FIGS. 1–4 as a generally rectangular wood guiding frame 22 having a front member 24, a rear member 26, a first side 28 and a second side 30. Preferably, the wood guiding frame 22 is slidably mounted into runners or tracks 32 which are attached to the base frame 5 parallel to the first edge 11 and second edge 13 of the base frame 5. The piece of wood to be split is placed within the wood guiding frame, and the wood guiding frame 22 can be reversibly drawn across the blade 20 along the runners 32, splitting off smaller pieces of wood each time the wood guiding frame 22 is passed over the blade 20. The runners or tracks 32 may be mounted to the front 7 and rear 9 support members, or to the first 11 and second 13 edges of the base frame 5. Preferably, the wood guiding frame 22 has at least one wheel 34 on each of the first 28 and second 30 sides. These wheels 34 fit within the runners 32, to facilitate movement of the wood guiding frame 22 along the runners 32.

The piece of wood to be split is preferably held within the wood guiding frame 22 between a pair of plates 36, oriented generally parallel to the first 28 and second 30 sides, and generally perpendicular to the front 24 and rear 26 members of the wood guiding frame 22. The plates 36 can be moved apart from each other to accommodate varying sizes of wood pieces that are to be split. Preferably, the plates 36 are mounted onto threaded bolts 38, the bolts being generally parallel to the front 24 and rear 26 members of the wood guiding frame 22. The bolts 38 may be secured to the front 24 and rear 26 members of the wood guiding frame 22, or the first 28 and second 30 sides of the wood guiding frame. The plates 36 are adjustably moved along the bolts 38 by moving nuts 40, thereby controlling the position of the plates 36. By moving the nuts 40 apart, the plates 36 can be moved apart to accommodate larger pieces of wood. Preferably, the piece of wood to be split is held loosely between plates 36, so that as the wood guide frame is reciprocated back and forth along the runners 32 and across the blade 20, gravity will assist in drawing the piece of wood down against the blade 20. Thus, as each successive pass of the wood guiding frame 22 over the blade 20 splits off a portion of wood, the remaining or parent piece of wood between the plates 36 will settle down against the blade 20 on subsequent passes, until the parent wood piece is completely split up into smaller portions. Other means of adjusting the position of the plates 36 are also possible. Reversibly attachable clamps and reversible locking devices commonly used in the art are also contemplated.

The wood guiding frame 22 is moved back and forth across the blade 20 by reciprocating means, shown in FIGS. 1–4 as a lever 42. Preferably, support booms 44, mounted to front support member 7 and perpendicular to the front support member 7 extend out in front of the base frame 5. The first end 46 of the lever 42 is pivotally mounted between the support booms 44 on a pin or bolt 48 attached between the support booms 44. Fastened to the lever 42 between the lever first end 46 and the lever's second end 49 are a pair of struts 50, one end of each strut 50 being pivotally attached to the lever 42 about a pin or bolt 52. The struts 50 are pivotally mounted at the other end of the struts to a pin or bolt 54 associated with the front member 24 of the wood guiding frame 22, the struts 50 being generally perpendicular to the front member 24 of the wood guiding frame 22. Thus, when the lever 42 is moved pivotally about the bolt or pin 48 between the support booms 44, the wood guiding frame is reciprocated by the struts 50. The length of the struts 50, and their position of pivotal attachment on the lever 42 between the first end 46 and second end 49 of the lever 42 will effect the amount of movement and force that can be imparted to the wood guiding frame 22 by movement of the lever 42.

Means for reciprocating the wood guide frame 22 other than by the lever 42 are also contemplated. The wood guiding means may be moved by hydraulic means, by a gasoline, diesel, or electric motor, by a ratchet and pall mechanism that incrementally increases pressure, or by other means of forcing a piece of wood against a wedge that are commonly used in the art.

The wood splitting device disclosed herein can be adjusted to split wood into portions of desired thickness. The thickness adjustment means is shown in FIGS. 1–4 as a generally horizontal plate 56 having first and second ends 58 and 60, set within the base frame 5. Bars 62 having a plurality of apertures 64 are vertically attached to the first and second ends 58 and 60 of the horizontal plate 56, so that horizontal plate 56 and bars 62 are perpendicular to each other. The vertical bars 62 are adjustably attached to the first and second sides 11 and 13 of the base frame 5 by pins or bolts. The pins or bolts fasten the horizontal bars 62 to the first and second sides 11 and 13 of the base frame 5 through the apertures in the bars 64. By attaching the pins or bolts to the bars 62 through different apertures 64, the position of the horizontal plate can be adjusted. The difference in position of the horizontal plate 54 and the horizontally attached blade 20 controls the thickness of the portions of wood that are split off the main (parent) piece of wood. By positioning the horizontal plate 56 slightly lower than the blade 20, thin portions of wood can be split from the parent piece of wood. As the horizontal plate is moved lower relative to the blade 20, by moving the pins or bolts to different apertures 64 in the bars 62, thicker portions of wood can be split from the parent piece of wood.

Other means of adjusting the position of the horizontal plate 56 are also contemplated. The bars 62 may also contain grooves rather than the apertures 64 shown in FIGS. 1–4. A bolt inserted through the groove could hold the bars in position with a washer and ring nut. By loosening the ring nut, the bars 62 could slide down, thereby moving the horizontal plate 54. Slots in the first and second sides 11 and 13 of the base frame could act as platforms to which the horizontal plate 54 could be attached; by moving the horizontal plate 54 to different slots, a different position and thus a different thickness of the split portion of wood, would be obtained. Other incrementally adjustable fastening means that are commonly used in the art, used to position the horizontal plate 54 relative to the blade 20, are also considered to be within the scope of this disclosure.

Mounted within the base frame 5 behind the blade 20 are a plurality of cylinders or rollers 70, preferable attached to and perpendicular to the first and second sides 11 and 13 of the base frame 5. The tops of the cylinders or rollers 20 are preferably level with the top of the blade 20. As the wood guide frame 22 is reciprocated along the runners 32 over the blade 20, the parent wood piece that is loosely held between plates 36 slides over these cylinders or rollers 70, preventing the parent wood piece from failing down into the base frame after passing over the blade 20. As the wood guiding frame is reciprocated forward again, the parent wood piece slides or rolls over the cylinders or rollers 70 until it passes back over the blade. The parent wood piece then drops down to the horizontal plate 54, still loosely held between the plates 36, and is ready for another pass at the blade 20.

The wood splitting device and its individual parts are preferably made of metal or metallic alloy. Because substantial forces may be applied, depending on the size of the wood splitting device and the parent pieces of wood to be split, the load bearing parts of the wood splitting device will generally be made of metal. The weight of the metal parts themselves will aid in forcing the wood against the blade 20, and in preventing the base frame 5 from undesired movement as the wood guiding frame 22 is reciprocated. However, it is recognized that the wood splitting device could be partly or largely made out of a variety of materials, including wood, ceramic, natural or synthetic polymers, and composite materials thereof.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity, it will be obvious that certain changes and modifications may be practiced within the scope of the appended claims.

What is claimed is:

1. A wood splitting device comprising:

a) a body element, wherein said body element comprises a generally rectangular base frame having a front support member, a rear support member, a fist side, and a second side;

b) means for splitting the wood mounted in said body element, wherein said splitting means comprises a splitting blade horizontally mounted between said first side and said second side of said rectangular base frame;

c) means for guiding the wood into said splitting means associated with said body element, wherein said wood guiding means comprises a generally rectangular frame having a front member, a back member, and first and second sides, said first and second sides of said wood guiding frame slidably mounted into runners tracks, said runners mounted to said base frame parallel to said first and second sides of said base frame;

d) means for reciprocating said wood guiding means associated with said body element; and e) means for adjusting incrementally a thickness of a split piece of the wood associated with said body element.

2. A wood splitting device according to claim 1, wherein said wood guiding frame has at least two plates generally parallel to said first and second sides of said wood guide frame, said plates adjustably mounted into said wood guiding frame so that said plates can be positioned to accommodate wood of varying sizes.

3. A wood splitting device according to claim 2, wherein said first and second sides of said wood guide frame each have at least one wheel, said wheels fitting into said runners mounted to said base frame parallel to said first and second sides of said base frame.

4. A wood splitting device according to claim 3, wherein said reciprocating means is a lever having first and second ends, said lever pivotally mounted at said first end to said front element of said base frame, and said lever pivotally mounted to the end at least one two ended strut at a point between said first end and said second end of said lever, the other end of said strut pivotally mounted to said front member of said wood guiding frame.

5. A wood splitting device according to claim 3, wherein a pair of support booms are mounted to said front support member of said base frame, said support booms being parallel to each other and perpendicular to said front support member of said base frame.

6. A wood splitting device according to claim 5, wherein said reciprocating means is a lever having first and second ends, said lever pivotally mounted at said first end to said support booms, and said lever pivotally mounted to the end of at least one two ended strut at a point between said first end and said second end of said lever, the other end of said strut pivotally mounted to the front member of said wood guiding frame.

7. A wood splitting device comprising:

a) a body element, wherein said body element comprises a generally rectangular base frame having a front support member, a rear support member, a first side, and a second side;

b) means for splitting the wood mounted in said body element, wherein said splitting means comprises a splitting blade horizontally mounted between said first side and said second side of said rectangular base frame;

c) means for guiding the wood into said splitting means associated with said body element, wherein said wood guiding means comprises a generally rectangular frame having a front member, a back member, and first and second sides, said first and second sides of said wood guiding frame slidably mounted into runners tracks, said runners mounted to said base frame parallel to said first and second sides of said base frame;

d) means for reciprocating said wood guiding means associated with said body element, wherein said reciprocating means is a lever having first and second ends, said lever pivotally mounted at said first end to said front element of said base frame, and said lever pivotally mounted to the end at least one two ended strut at a point between said first end and said second end of said lever, the other end of said strut pivotally mounted to said front member of said wood guiding frame; and e) means for adjusting incrementally a thickness of a split piece of the wood associated with said body element.

8. A wood splitting device according to claim 7, wherein said incremental adjusting means comprises a generally horizontal plate having first and second ends set within said base frame and bars having a plurality of apertures are vertically attached to said first and second plate ends, wherein said vertical bars are adjustably attached to said first and second sides of said base frame by thickness adjustable means that cooperate with said plurality of apertures.

* * * * *